US012708191B2

(12) United States Patent
Clearman et al.

(10) Patent No.: US 12,708,191 B2
(45) Date of Patent: Aug. 18, 2026

(54) BACKPACK STRAP ACCESSORY DEVICES, SYSTEMS, AND METHODS

(71) Applicant: CLEARMAN LABS, LLC, Boulder, CO (US)

(72) Inventors: Christopher Aaron Clearman, Boulder, CO (US); Samuel R. Goodhue, Longmont, CO (US)

(73) Assignee: Clearman Labs, LLC, Boulder, CO (US)

( * ) Notice: Subject to any disclaimer, the term of this patent is extended or adjusted under 35 U.S.C. 154(b) by 153 days.

(21) Appl. No.: 18/240,653

(22) Filed: Aug. 31, 2023

(65) Prior Publication Data

US 2024/0065421 A1 Feb. 29, 2024

Related U.S. Application Data

(60) Provisional application No. 63/474,622, filed on Aug. 31, 2022.

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01); *A45F 2003/045* (2013.01)

(58) Field of Classification Search
CPC ..... A45F 2003/001; A45F 5/021; A45F 3/04
USPC ..... 224/639, 648–649, 663, 646
See application file for complete search history.

(56) References Cited

U.S. PATENT DOCUMENTS 4,319,704 A * 3/1982 Rosen ..... A45F 5/02 224/907
5,797,212 A * 8/1998 Kistner ..... A01K 97/10 224/922
5,813,584 A * 9/1998 Mauser ..... A45F 5/00 446/28
6,510,592 B1 * 1/2003 Hamilton ..... A44B 11/06 24/3.1

(Continued)

OTHER PUBLICATIONS

Packmod Rainshield Pocket. REI Co-op [retrieved on Sep. 3, 2025]. Retrieved from the Internet: <URL:https://www.rei.com/product/217465/rei-co-op-packmod-rainshield-pocket>.

(Continued)

*Primary Examiner* — Scott T McNurlen
(74) *Attorney, Agent, or Firm* — Wilson Patent Law, LLC

(57) ABSTRACT

Backpack strap accessory methods, systems, and device are provided in accordance with various embodiments. Some embodiments include a device that may include a backpack accessory. The device may include one or more attachment appendages coupled with the backpack accessory where the one or more attachment appendages are configured to couple the backpack accessory with a backpack shoulder strap. The device may include one or more rigid members coupled with the backpack accessory such that at least one of the rigid members hinder a motion of the backpack accessory in at least one direction along a length of the backpack shoulder strap with respect to a hardware coupled with the backpack shoulder strap. Some embodiments include one or more apertures formed with respect to the attachment appendages such that a sternum strap coupled with the backpack shoulder strap passes through at least one of the one or more apertures.

9 Claims, 11 Drawing Sheets

(56) References Cited

U.S. PATENT DOCUMENTS

| | | | | |
|---|---|---|---|---|
| 8,622,264 | B2 * | 1/2014 | Messner | B63C 11/22 24/321 |
| 10,085,544 | B2 * | 10/2018 | Schessel | F16B 2/005 |
| 2006/0101627 | A1 * | 5/2006 | Ida | A44B 11/26 24/517 |
| 2006/0113340 | A1 * | 6/2006 | Goradesky | A45F 5/02 224/269 |

OTHER PUBLICATIONS

Shoulder Pocket by Hyperlite Mountain Gear. Garage Grown Gear [retrieved on Sep. 3, 2025]. Retrieved from the Internet: <URL:https://www.garagegrowngear.com/products/shoulder-pocket-by-hyperlite-mountain-gear?_pos=4&_sid=79987bee7&_ss=r>.

Shoulder Pouch by Bonfus. Garage Grown Gear [retrieved on Sep. 3, 2025]. Retrieved from the Internet: <URL:https://www.garagegrowngear.com/products/shoulder-pouch-by-bonfus?_pos=5&_sid=79987bee7&_ss=r>.

Shoulder Strap Pocket by Gossamer Gear. Garage Grown Gear [retrieved on Sep. 3, 2025]. Retrieved from the Internet: <URL:https://www.garagegrowngear.com/products/shoulder-strap-pocket-by-gossamer-gear?_pos=1&_sid=79987bee7&_ss=r>.

Shoulder Strap Pocket by Trekker Joe's. Garage Grown Gear [retrieved on Sep. 3, 2025]. Retrieved from the Internet: <URL:https://www.garagegrowngear.com/products/diver-mesh-shoulder-strap-pocket-by-trekker-joes?_pos=2&_sid=79987bee7&_ss=r>.

ULTRA Shoulder Strap Pocket. ULA Equipment [retrieved on Sep. 3, 2025]. Retrieved from the Internet: <URL:https://www.ula-equipment.com/product/ultra-shoulder-strap-pocket/>.

Zippered Shoulder Strap Pocket by Chicken Tramper Gear. Garage Grown Gear [retrieved on Sep. 3, 2025]. Retrieved from the Internet: <URL:https://www.garagegrowngear.com/products/chest-strap-pocket-by-chicken-tramper-gear?_pos=3&_sid=79987bee7&_ss=r>.

* cited by examiner

BACKPACK STRAP ACCESSORY DEVICES, SYSTEMS, AND METHODS

CROSS-REFERENCES TO RELATED APPLICATIONS

This application is a non-provisional patent application claiming priority benefit of U.S. provisional patent application Ser. No. 63/474,622, filed on Aug. 31, 2022 and entitled "UNIVERSAL BACKPACK STRAP ACCESSORY POCKET," the entire disclosure of which is herein incorporated by reference for all purposes.

BACKGROUND

It is often inconvenient and time consuming to remove a backpack to retrieve small items from it. There may be various products on the market that may attach to backpack straps, such as shoulder straps, but these are generally designed for specific backpack models. There may be some strap pockets that are marketed to fit various backpacks, but their attachment mechanisms are generally lacking such that the pocket often slides down the strap into an inconvenient position or falls off entirely.

There thus may be a need for tools and techniques for attaching an accessory pocket to a variety of backpack shoulder straps that may avoid these various problems.

SUMMARY

Backpack strap accessory methods, systems, and devices are provided in accordance with various embodiments. For example, some embodiments include a device that includes a backpack accessory. The device may include one or more attachment appendages coupled with the backpack accessory where the one or more attachment appendages are configured to couple the backpack accessory with a backpack shoulder strap. The device may also include one or more rigid members coupled with the backpack accessory such that at least one of the rigid members hinders a motion of the backpack accessory in at least one direction along a length of the backpack shoulder strap with respect to a hardware coupled with the backpack shoulder strap.

In some embodiments of the device, the one or more rigid members includes a first rigid member and a second rigid member coupled with the backpack accessory such that the hardware coupled with the backpack shoulder strap is confined between the first rigid member and the second rigid member. In some embodiments, the hardware is coupled with a sternum strap coupled with the backpack shoulder strap. In some embodiments, the one or more rigid members are formed from high density polyethylene (HDPE). The backpack accessory may include one or more pockets.

Some embodiments of the device further include one or more apertures formed with respect to a first attachment point and a second attachment point coupling at least one of the one or more attachment appendages with the backpack accessory. At least one of the one or more apertures may be configured such that a sternum strap coupled with the backpack shoulder strap passes through at least one of the one or more apertures.

In some embodiments of the device, the one or more attachment appendages include at least two attachment appendages that include a hook and loop configuration to couple the backpack accessory with the backpack shoulder strap. Some embodiments of the device further include one or more pads coupled with at least one of the one or more attachment appendages. In some embodiments, the one or more rigid members include one or more rigid bars.

Some embodiments include a method that includes attaching a backpack accessory to a backpack shoulder strap such that one or more rigid members coupled with the backpack accessory hinder a motion of the backpack accessory in at least one direction along a length of the backpack shoulder strap with respect to a hardware coupled with the backpack shoulder strap. In some embodiments, attaching the backpack accessory to the backpack shoulder strap such that the one or more rigid members coupled with the backpack accessory hinder the motion of the backpack accessory in at least one direction along the length of the backpack shoulder strap with respect to the hardware coupled with the backpack shoulder strap includes positioning the one or more rigid members coupled with the backpack accessory with respect to the hardware coupled with the backpack shoulder strap.

In some embodiments of the method, positioning the one or more rigid members coupled with the backpack accessory with respect to the hardware coupled with the backpack shoulder strap includes trapping the hardware between a first rigid member from the one or more rigid members and a second rigid member from the one or more rigid members. In some embodiments, the hardware coupled with the backpack shoulder strap is coupled with a sternum strap.

In some embodiments of the method, attaching the backpack accessory to the backpack shoulder strap includes wrapping one or more attachment appendages coupled with the backpack accessory around the backpack shoulder strap. In some embodiments, wrapping the one or more attachment appendages around the backpack shoulder strap includes wrapping a first attachment appendage around the backpack shoulder strap and a second attachment appendage around the backpack shoulder strap and coupling the first attachment appendage with the second attachment appendage. Some embodiments of the method include passing at least a portion of a sternum strap coupled with the backpack shoulder strap through an aperture formed with respect to a first attachment point and a second attachment point coupling at least one of the one or more attachment appendages with the backpack accessory.

Some embodiments of the method include inserting an object into the backpack accessory where the backpack accessory includes one or more pockets. In some embodiments, the one or more rigid members are formed from high density polyethylene (HDPE). In some embodiments, the one or more rigid members include one or more rigid bars.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label and/or a dash and a third label that may distinguish among the similar components. If only the first reference label is used in the specification, the description is applicable to any one of the similar components having the same first reference label irrespective of the second reference label.

DETAILED DESCRIPTION

Figure 1:
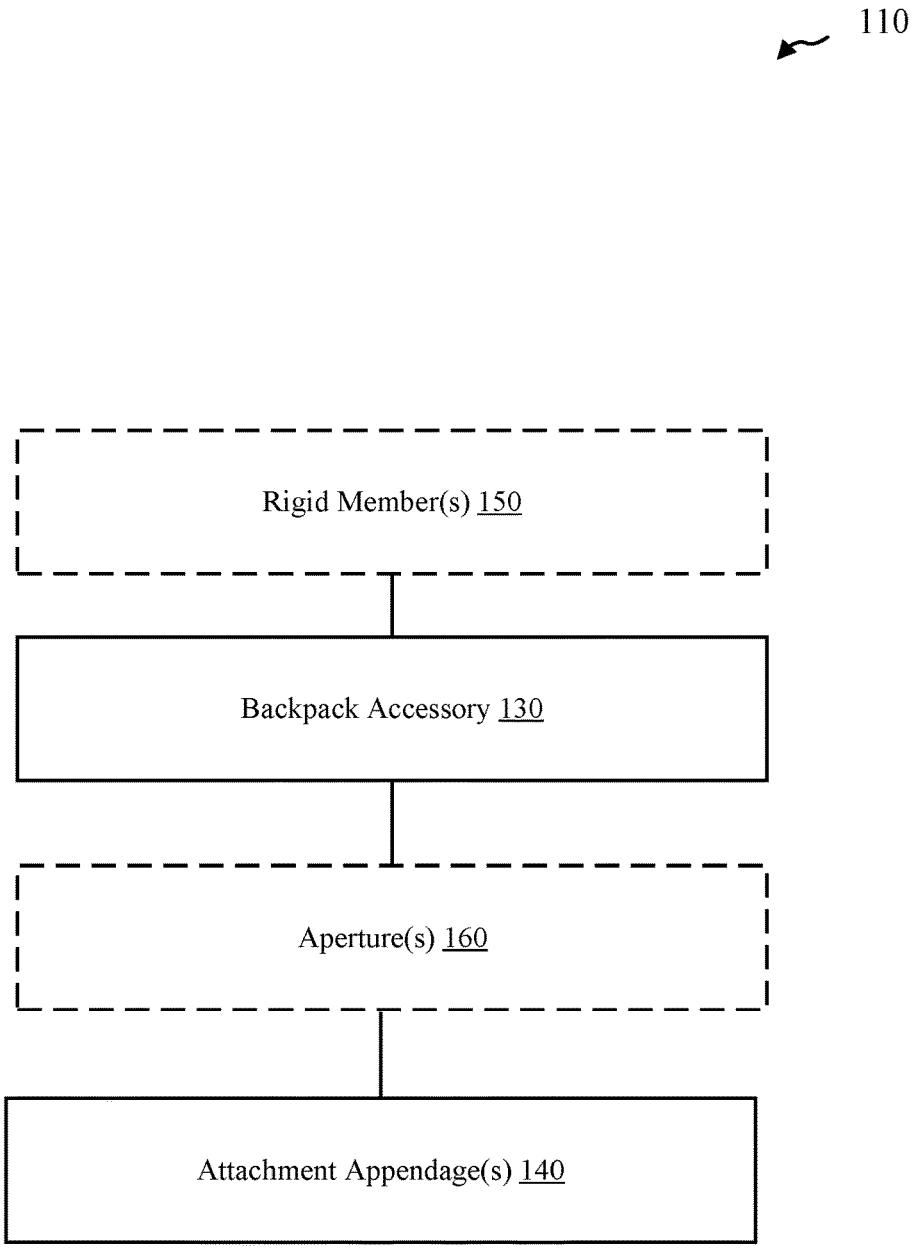
FIG. 1 shows a device in accordance with various embodiments.

This description provides embodiments, and is not intended to limit the scope, applicability or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted, or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Backpack strap accessory methods, systems, and devices are provided in accordance with various embodiments. Various embodiments may allow for securely attaching a backpack accessory, such as a pocket to a wide variety of backpack straps, such as shoulder straps. Some embodiments are intended for storing small items and may include one or more pockets, zipper pockets, stretch pockets, drawcord pockets, or any other pocket design and/or attachment design such as MOLLE webbing or hardware. Embodiments generally provide for quick access to frequently used equipment and/or essentials. For example, items such as phones, passports, boarding passes, glasses, GPS devices, snacks, etc. may be held in the backpack accessory. Various embodiments may provide for a universal backpack strap accessory pocket.

Some embodiments include a backpack accessory that may be attached to the backpack strap using hook and loop (otherwise known as Velcro) attachment appendages that overlap and attach to one another to surround and entrap the backpack shoulder strap. These attachment appendages may be referred to as wings in some embodiments. Some embodiments utilize one wing or any multitude of wings. Some embodiments utilize two wings, for example. In some embodiments, the attachment appendages or wings have padding on the back side of one, some, or all of the attachment appendages, which may provide padding against the wearer's body.

Some embodiments include one or more holes, openings, or slots (or apertures in general) with respect to the attachment appendages that surround the backpack shoulder strap. These holes or slots generally allow a backpack's sternum strap to pass through the attachment appendages (or between the attachment appendage and the backpack accessory) when the backpack accessory is installed or coupled with a backpack. There may be one slot or a multitude of slots for the sternum strap, which may be positioned on one side or both sides of the backpack accessory.

Some embodiments include one or more rigid members coupled with a back side of the backpack accessory, such as the accessory pocket, but may be inside the closed loop created when the attachment appendage(s) are used to couple with the backpack shoulder strap. These rigid members may be pressed securely against the front of the backpack shoulder strap when the backpack accessory is secured to the backpack shoulder strap using the attachment appendages. These rigid members may have a non-rigid space between them occupied by only fabric, foam, or other soft and/or flexible materials, or no material at all. When installed, this non-rigid space or empty area may be occupied by various hardware coupled with the backpack strap, such as the plastic or metal hardware that attaches the sternum strap of the backpack to the backpack shoulder straps. The rigid members may trap the plastic or metal hardware in place, which may prevent the backpack accessory from sliding upward or downward on the backpack shoulder strap.

In some embodiments, the apertures formed with respect to the attachment appendages may allow for a sternum strap to escape from being trapped between the backpack accessory and the backpack shoulder strap. The escaped sternum strap may then function properly through connecting to an opposing backpack shoulder strap. This may also facilitate keeping the backpack accessory from sliding up or down the backpack shoulder strap. The rigid members that may trap the plastic or metal hardware that may attach the sternum strap to the backpack shoulder straps generally provide a similar function. These features may work in unison to provide methods, systems, and/or devices that may be capable of securely attaching a backpack accessory to a wide variety of backpack shoulder straps. These various embodiments generally provide performance improvement over other products that may generally slip around when attached to a backpack shoulder strap. Some embodiments utilize the aperture features without the rigid members while others utilize the rigid member features without the aperture features.

Turning now to FIG. 1, a device 110 is provided in accordance with various embodiments. Device 110 may be referred to as a backpack strap accessory device. Some embodiments are referred to as a universal backpack strap accessory pocket or a universal strap pocket. Device 110 may include a backpack accessory 130. Device 110 may include one or more attachment appendages 140 coupled with the backpack accessory 130 where the one or more attachment appendages 140 are configured to couple the backpack accessory 130 with a backpack shoulder strap. The device 110 may also include one or more rigid members 150 coupled with the backpack accessory 130 such that at least one of the rigid members 150 hinder a motion of the backpack accessory 130 in at least one direction along a length of the backpack shoulder strap with respect to a hardware coupled with the backpack shoulder strap. The hardware can include a wide variety of components and may be constructed from a wide variety of materials. In general, the hardware may be coupled with the backpack shoulder strap and coupled with a sternum strap, though the hardware may also be coupled with other components besides or instead of a sternum strap. The hardware may be constructed from various rigid materials including, but not limited to, plastic and/or metal. Examples of hardware may include, but are not limited to, handle slides, rings, swivel hooks, flip locks, buckles, releases, and/or oblongs.

In some embodiments of the device 110, the one or more rigid members 150 includes a first rigid member and a second rigid member coupled with the backpack accessory 130 such that the hardware coupled with the backpack shoulder strap is confined between the first rigid member and the second rigid member. In some embodiments, the hardware is coupled with a sternum strap coupled with the backpack shoulder strap. In some embodiments, the one or more rigid members 150 are formed from high density polyethylene (HDPE). The one or more rigid members 150 may include various other materials and/or constructions, including, but not limited to, stitched layers of cloth, layered composites, and/or metal. Some embodiments of the backpack accessory 130 may include one or more pockets. The backpack accessory 130 may include a wide variety of forms, including, but not limited to one or more pockets, zipper pockets, stretch pockets, drawcord pockets, or any other pocket design and/or attachment design such as MOLLE webbing or hardware. The backpack accessory 130 may be waterproofed.

Some embodiments of the device 110 further include one or more apertures 160 formed with respect to a first attachment point and a second attachment coupling at least one of the one or more attachment appendages 140 with the backpack accessory 130. At least one of the one or more apertures 160 may be configured such that a sternum strap coupled with the backpack shoulder strap passes through at least one of the one or more apertures 160.

In some embodiments of the device 110, the one or more attachment appendages 140 include at least two attachment appendages that include a hook and loop configuration to couple the backpack accessory 130 with the backpack shoulder strap; other attachment structures may be utilized including, but not limited to, snaps and/or wrap around clips. In some embodiments, the one or more attachment appendages 140 may include one or more hook and loop straps that may wrap around a backpack shoulder strap. Some embodiments of the device further include one or more pads coupled with at least one of the one or more attachment appendages. In some embodiments, the one or more rigid members include one or more rigid bars. In some embodiments, a breathable spacer mesh panel may form one or more of the attachment appendages 140. In general, various structures may be utilized to facilitate keeping the backpack accessory 130 and/or attachment appendage(s) 140 in contact with the back shoulder strap, such as zippers, snaps, hooks, buckles, hook and loop, buttons, elastic, ties, or clips coupled with the attachment appendage(s) 140.

Some embodiments of device 110 include the backpack accessory 130 and attachment appendage(s) 140 along with both rigid member(s) 150 and aperture(s) 160. Some embodiments of device 110 include the backpack accessory 130 and attachment appendage(s) 140 along with rigid member(s) 150 without aperture(s) 160, while some embodiments of device 110 include the backpack accessory 130 and attachment appendage(s) 130 along with aperture(s) 160 without rigid member(s) 150.

Figure 2A:
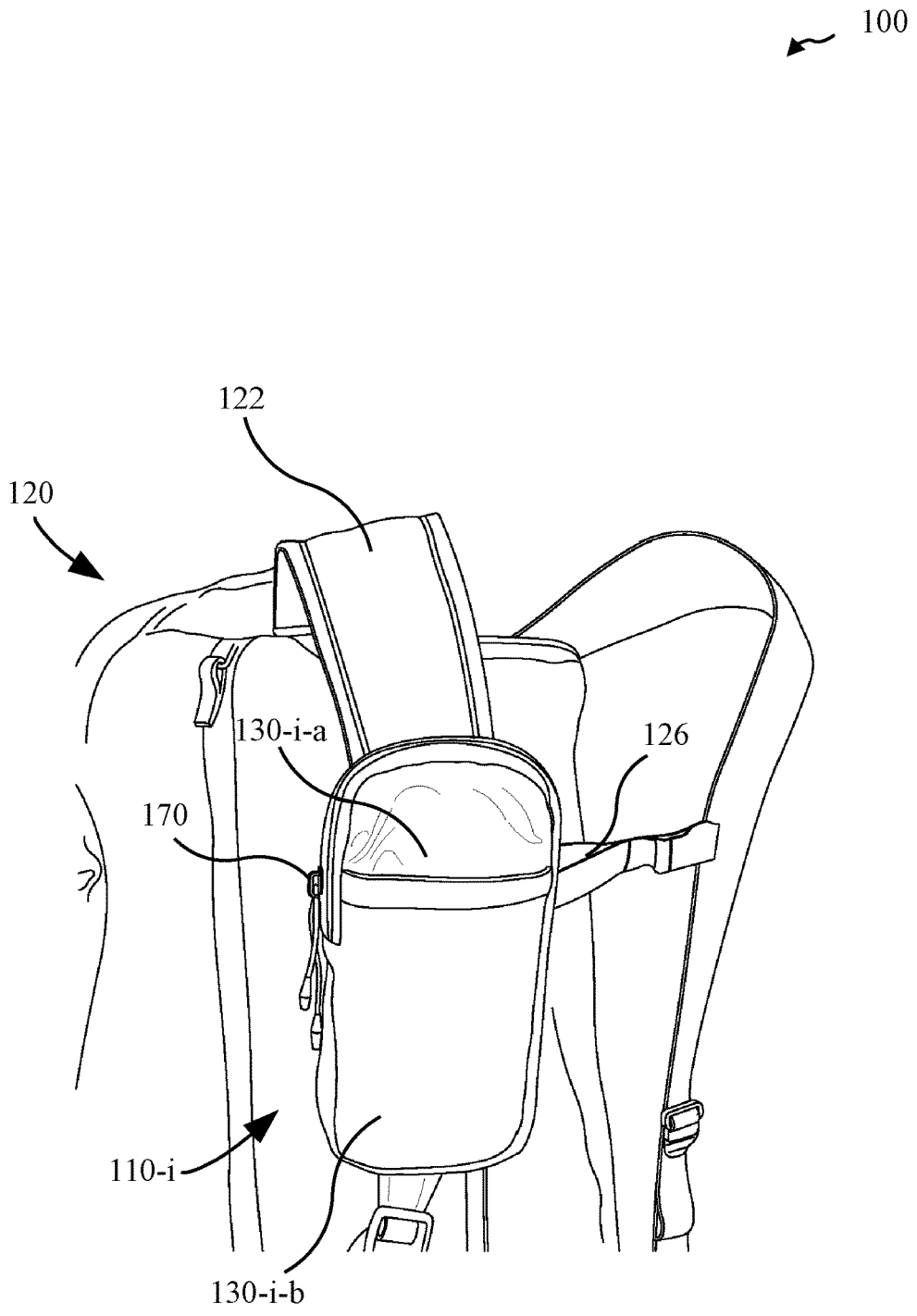
FIG. 2A shows a system and a device in accordance with various embodiments.
Figure 2B:
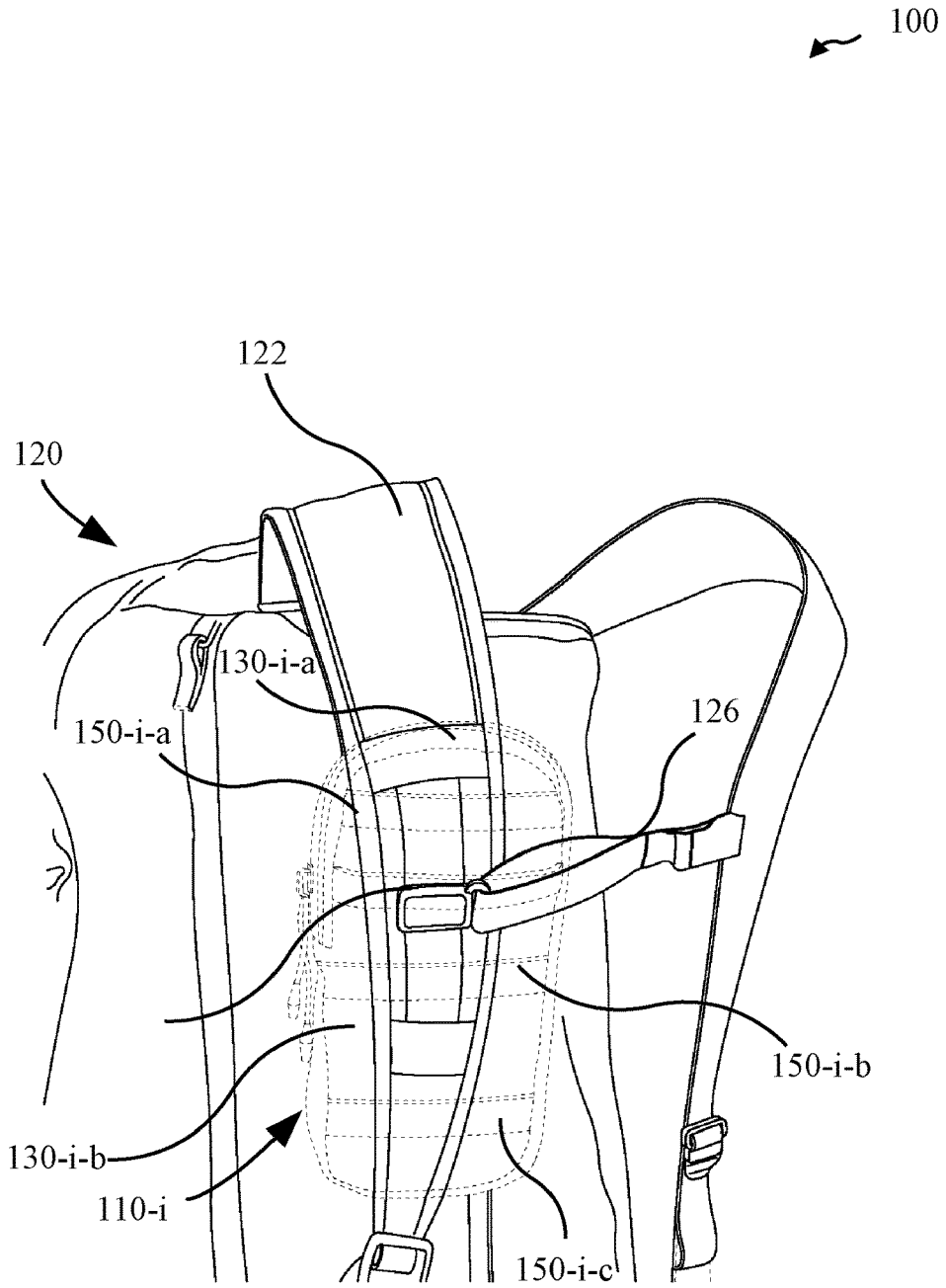
FIG. 2B shows a system and a device in accordance with various embodiments.

Turning now to FIG. 2A and FIG. 2B, a system 100 is shown in accordance with various embodiments. System 100 may include a device 110-*i*, which may be an example of device 110 of FIG. 1; FIG. 2A and FIG. 2B show device 110-*i* coupled with a backpack shoulder strap 122 of a backpack 120. FIG. 2B shows device 110-*i* as being transparent, which may allow one to view aspects of system 100 that may be obscured from view. System 100 generally shows device 110-*i* from a front side. Device 110-*i* may include a zipper pocket 130-*i*-*a*, with a zipper 170; some embodiments include an outer pocket 130-*i*-*b* with an open top. Backpack 120 may include a sternum strap 126 that may be coupled with the one or more shoulder straps 122.

The transparent view of FIG. 2B shows several features of system 100 with respect to device 110-*i*. For example, device 110-*i* may also include one or more rigid members 150-*i* coupled with the backpack accessory 130-*i*-*a* such that at least one of the rigid members 150-*i* hinders a motion of the backpack accessory 130-*i*-*a* in at least one direction along a length of the backpack shoulder strap 122 with respect to a hardware 124 coupled with the backpack shoulder strap 122. In this example, these features hinder motion up and down the backpack shoulder strap 122 of the backpack accessory 130-*i*-*a*. For example, the one or more rigid members 150-*i* may include a first rigid member 150-*i*-*a* and a second rigid member 150-*i*-*b* coupled with the backpack accessory 130-*i*-*a* such that the hardware 124 coupled with the backpack shoulder strap 122 may be confined between the first rigid member 150-*i*-*a* and the second rigid member 150-*i*-*b*. Device 110-*i* may also show a third rigid member 150-*i*-*c*.

FIG. 2A and FIG. 2B also generally show sternum strap 126 coupled with the backpack shoulder strap 122 that may pass through at least one of the one or more apertures formed with respect to the backpack accessory 130-*i*-*a* and one or more attachment appendages (obscured from view). The sternum strap 126 may be coupled with hardware 124 and may also be coupled to the opposing backpack shoulder strap. This configuration may further facilitate keeping the backpack accessory 130-*i*-*a* from sliding up and down the backpack shoulder strap 122.

Figure 3:
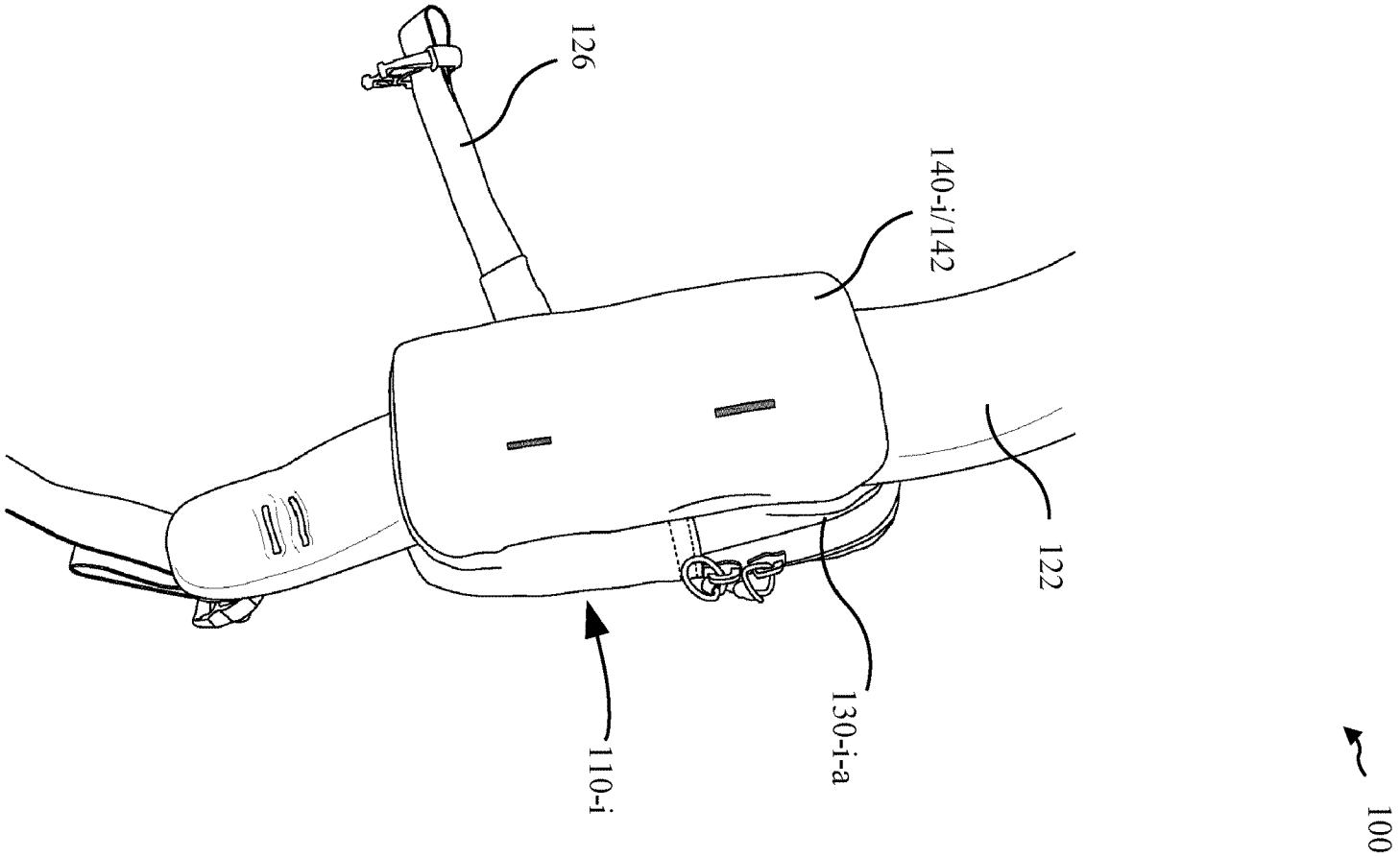
FIG. 3 shows a system and a device in accordance with various embodiments.

FIG. 3 shows another perspective of device 110-*i* as part of system 100 in accordance with various embodiments. Device 110-*i* is generally shown from a back side. A backpack shoulder strap 122 may be shown with device 110-*i* coupled with the backpack shoulder strap 122 utilizing one or more attachment appendages 140-*i*. Attachment appendage 140-*i* that may be visible may include a pad or padded portion 142. The pad 142 may be oriented such that it may be positioned between the backpack shoulder strap 122 and backpack accessory 130-*i*-*a* and a portion of a person, such as the shoulder of a person. The attachment appendage 140-*i* may include a first attachment appendage (obscured from view) and the shown second attachment appendage 140-*i*. These may wrap around the backpack shoulder strap 122 and couple with each other utilizing various coupling mechanisms including, but not limited to, hook and loop (i.e., Velcro) attachments, snaps, and/or wrap around clips. A sternum strap 126 may also be shown. In some embodiments, the sternum strap 126 may pass through an aperture (obscured from view) formed with respect to one of the attachment appendages 140-*i* and the backpack accessory 130-*i*-*a*.

Figure 4A:
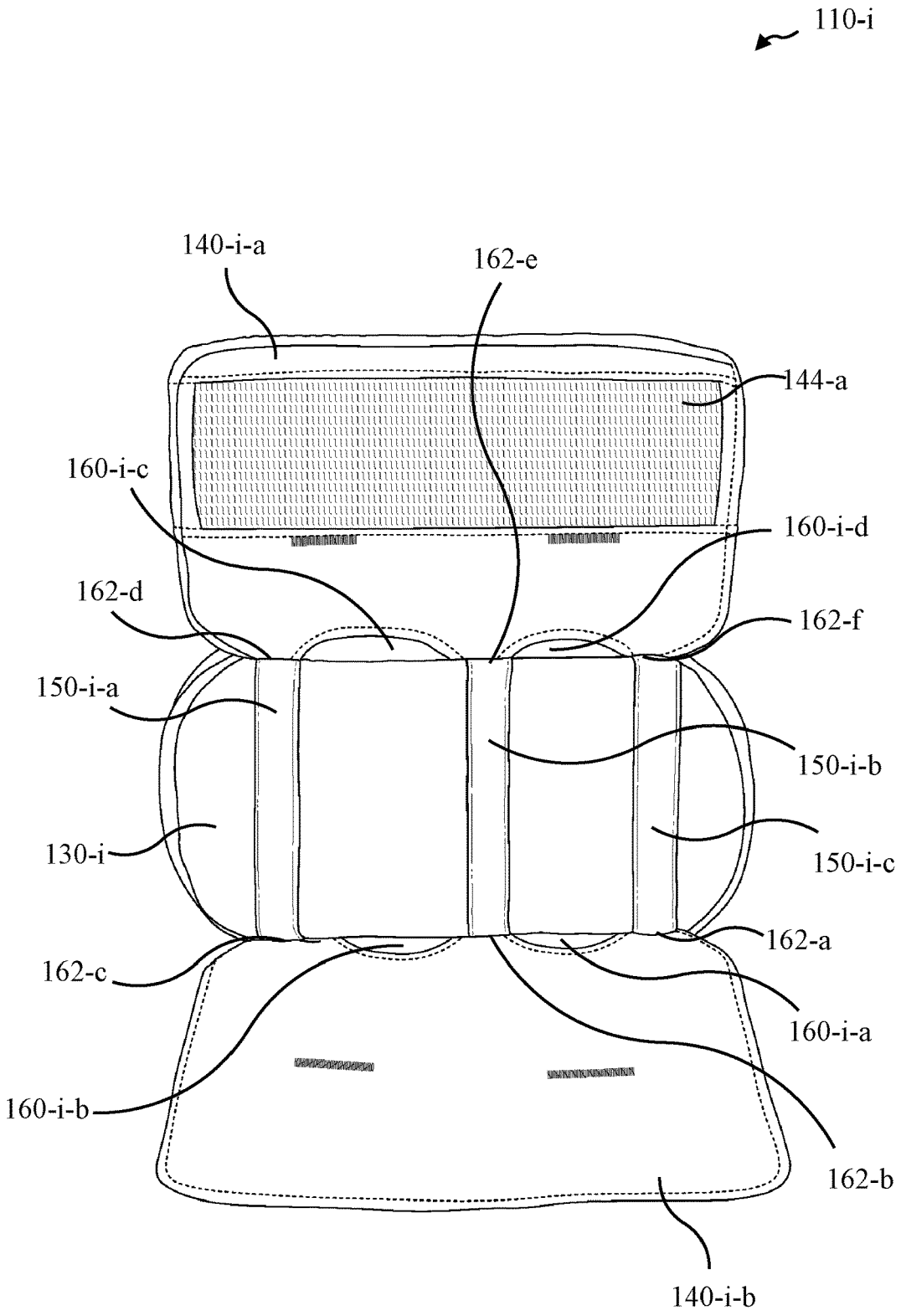
FIG. 4A shows a device in accordance with various embodiments.
Figure 4B:
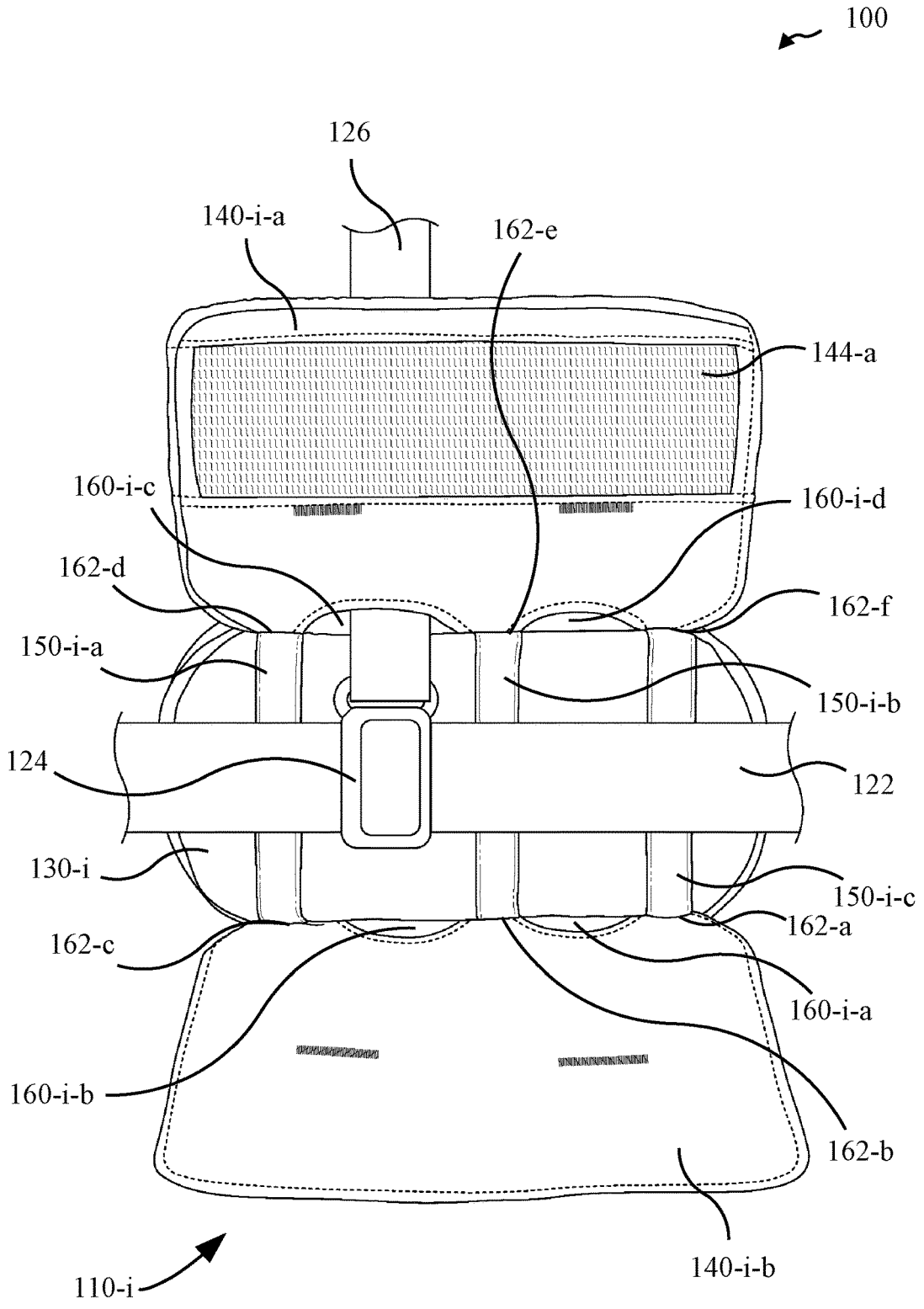
FIG. 4B shows a system and a device in accordance with various embodiments.

Turning now to FIG. 4A and FIG. 4B, two perspectives of device 110-*i* are provided in accordance with various embodiments In both views, the attachment appendages 140-*i*-*a* and 140-*i*-*b* are shown in an open configuration prior to being utilized to couple the device with a backpack shoulder strap, for example. These perspectives expose the rigid members 150-*i*-*a*, 150-*i*-*b*, and 150-*i*-*c* that may be coupled to the back side of the backpack accessory 130-*i*.

FIG. 4A and FIG. 4B show various apertures 160-*i* that may be formed through creating openings between one of the attachment appendages 140-*i* and the backpack accessory 130-*i*. For example, aperture 160-*i*-*a* may be formed with respect to a first attachment point 162-*a* and a second attachment point 162-*b* coupling at least one of the one or more attachment appendages 140-*i*-*b* with the backpack accessory 130-*i*. The first attachment point 162-*a* and the second attachment point 162-*b* may be formed as segments between the attachment appendage 140-*i*-*b* and the backpack accessory 130-*i*. The other apertures 160-*i* may also have respective attachment points, such as attachment points 162-*b* and 162-*c* for aperture 160-*i*-*b*, attachment points 162-*d* and 162-*e* for aperture 160-*i*-*c*, and attachment points 162-*e* and 162-*f* for aperture 160-*i*-*d*.

These segments or attachment points may represent where the attachment appendage 140-*i*-*a* and the backpack accessory 130-*i* are coupled with each other utilizing a variety of tools and techniques including, but not limited to, sewing, gluing, and/or fusing. In some embodiments, the attachment points 162 may provide a continuous portion between the attachment appendage 140-*i* and the backpack accessory 130-*i*; the apertures 160-*i* may be formed from cutting the aperture 160-*i* to form between the attachment appendage portion 140-*i* and the backpack accessory 130-*i*.

FIG. 4A and FIG. 4B also show multiple rigid members 150-*i*-*a*, 150-*i*-*b*, and 150-*i*-*c*. FIG. 4B generally highlights how these rigid members 150-*i* may hinder a motion of the backpack accessory 130-*i* in at least one direction along a length of the backpack shoulder strap 122 with respect to a hardware 124 coupled with the backpack shoulder strap 122; the hardware 124 may be coupled with sternum strap 126. FIG. 4B shows in particular how rigid members 150-*i*-*a* and 150-*i*-*b* may be coupled with the backpack accessory 130-*i* such that the hardware 124 coupled with the backpack shoulder strap 122 is confined between the rigid member 150-*i*-*a* and the rigid member 150-*i*-*b*. When the attachment appendages 140-*i*-*a* and 140-*i*-*b* may be wrapped around backpack shoulder strap 122, the hardware 124 may be limited in its movement between rigid members 150-*i*-*a* and 150-*i*-*b*. From the perspective of FIG. 4B, this would involve limiting the lateral movement of the hardware 124 with respect to the rigid members 150-*i*-*a* and 150-*i*-*b*. When the device 110-*i* is coupled with the backpack shoulder strap 122, the hardware 124 and rigid members 150-*i*-*a* and 150-*i*-*b* work together to limit the up and down movement of the device along the backpack shoulder strap 122, thus generally keeping the device 110-*i* localized on the backpack shoulder strap 122.

FIG. 4B also shows how the various apertures 160-*i* that may be configured such that a sternum strap 126 coupled with the backpack shoulder strap 122 may pass through a respective aperture. When the sternum strap 126 may be coupled with the opposing backpack shoulder strap (not shown), this may help further localize the position of the device along the backpack shoulder strap 122. In this example, the sternum strap 126 may pass through aperture 160-*i*-*c*, though the other apertures may be utilized for repositioning the device 110-*i* higher on the backpack shoulder strap 122 or on the opposing backpack shoulder strap (not shown). In general, the sternum strap 126 may be fed through one of the apertures 160-*i* (which may also be referred to as side holes) for a more secure fit.

The apertures 160-*i* formed with respect to the attachment appendages 140-*i* may thus allow for sternum strap 126 to escape from being trapped between the backpack accessory 130-*i* and the backpack shoulder strap 122. The escaped sternum strap 126 may then function properly through connecting to an opposing backpack shoulder strap (not shown). This may also facilitate keeping the backpack accessory 130-*i* from sliding up or down the backpack shoulder strap 122. The rigid members 150-*i* that may trap the hardware 124 that may attach the sternum strap 126 to the backpack shoulder strap 122 generally provide a similar function. Some embodiments utilize the aperture features 160-*i* while others utilize the rigid member features 150-*i*. Some embodiments utilize both features in unison to provide methods, systems, and/or devices that may be capable of securely attaching a backpack accessory 130-*i* to a wide variety of backpack shoulder straps 122. These various embodiments generally provide performance improvement over other products that may generally slip around when attached to a backpack shoulder strap 122.

The rigid members 150-*i* may be constructed from a wide variety of materials including, but not limited to, rigid plastic such as high density polyethylene (HDPE), stitched layers of cloth, layered composites, and/or metal. The rigid members 150-*i* may be coupled with the backpack accessory 130-*i* in a wide variety of ways including, but not limited to gluing, fusing, and/or sewing. In some embodiments, the rigid members 150-*i* may be sewn to the backpack accessory 130-*i* through sewing fabric around the rigid members 150-*i*.

Some embodiments of device 110-*i* utilize multiple attachment appendages 140-*i*. For example, FIG. 4A and FIG. 4B generally show the use of two attachment appendages 140-*i*-*a* and 140-*i*-*b*. Some embodiments of device 110-*i* can be configured with one attachment appendage 140-*i* that may wrap or slide around the backpack shoulder strap without a second attachment appendage. Various structures may be utilized to facilitate keeping the backpack accessory 130-*i* and/or attachment appendage in contact with the back shoulder strap, such as zippers, snaps, hooks, buckles, hook and loop, buttons, elastic, ties, or clips coupled with the attachment appendage 140-*i* and/or backpack accessory 130-*i*.

Figure 5:
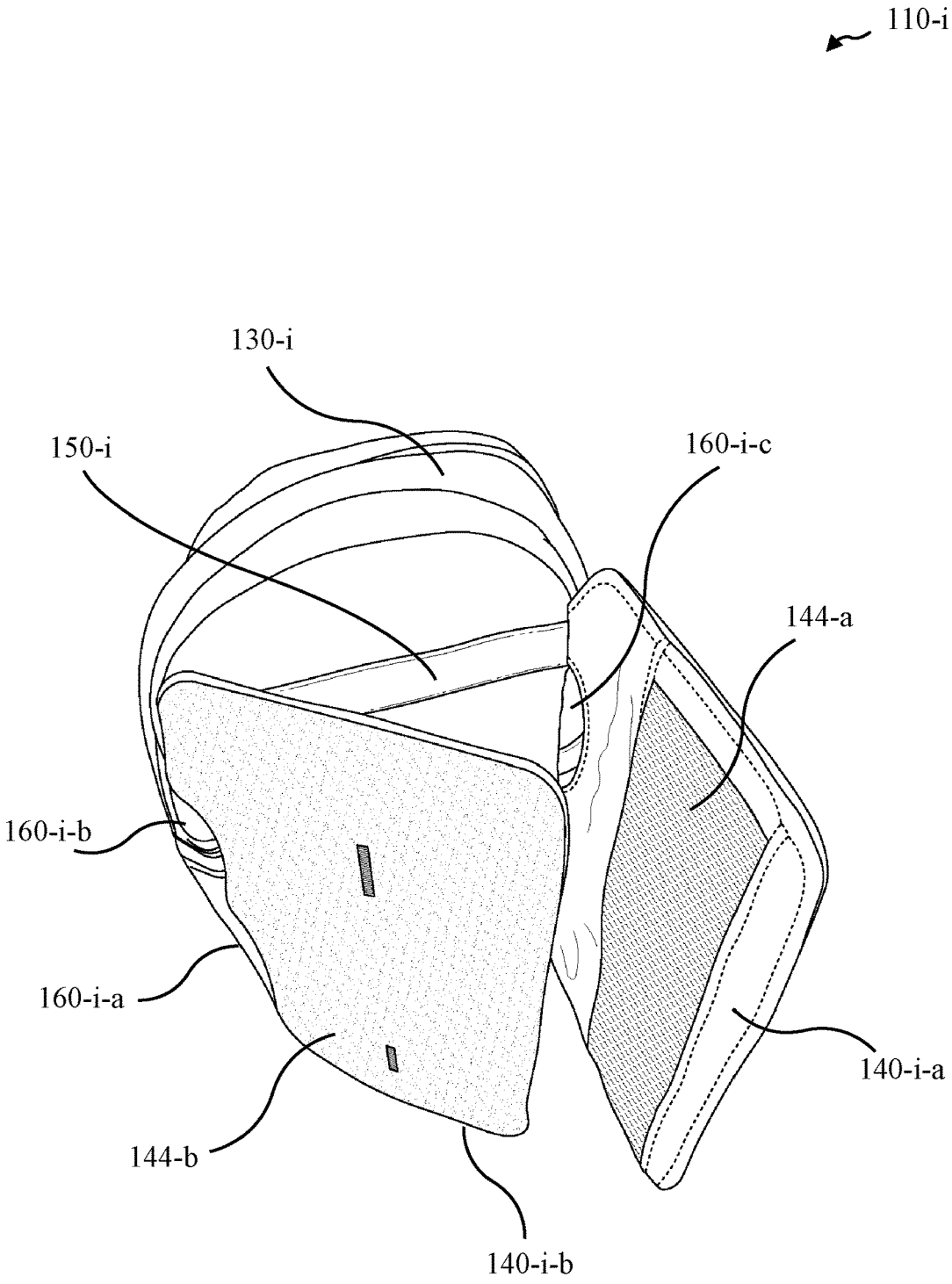
FIG. 5 shows a device in accordance with various embodiments.

FIG. 5 shows another perspective of device 110-*i* in accordance with various embodiments. In particular, this perspective shows a first attachment appendage 140-*i*-*a* with a first hook and loop portion 144-*a* and a second attachment appendage 140-*i*-*b* with a second hook and loop portion 144-*b*. The first attachment appendage 140-*i*-*a* and the second attachment appendage 140-*i*-*b* may wrap around a backpack shoulder strap and then couple with each other utilizing the first hook and loop portion 144-*a* and the second hook and loop portion 144-*b*.

FIG. 5 also shows a backpack accessory 130-*i* configured as a pocket. A rigid member 150-*i* is shown; some embodiments include additional rigid members that may be obscured from view.

FIG. 5 also shows multiple apertures 160-*i*-*a*, 160-*i*-*b*, and 160-*i*-*c* (a fourth aperture may be obscured from view) that may be formed with respect to a first attachment point and a second attachment point coupling at least one of the one or more attachment appendages 140-*i* with the backpack accessory 130-*i*. At least one of the one or more apertures 160-*i* may be configured such that a sternum strap coupled with the backpack shoulder strap passes through at least one of the one or more apertures 160-*i*.

Figure 6:
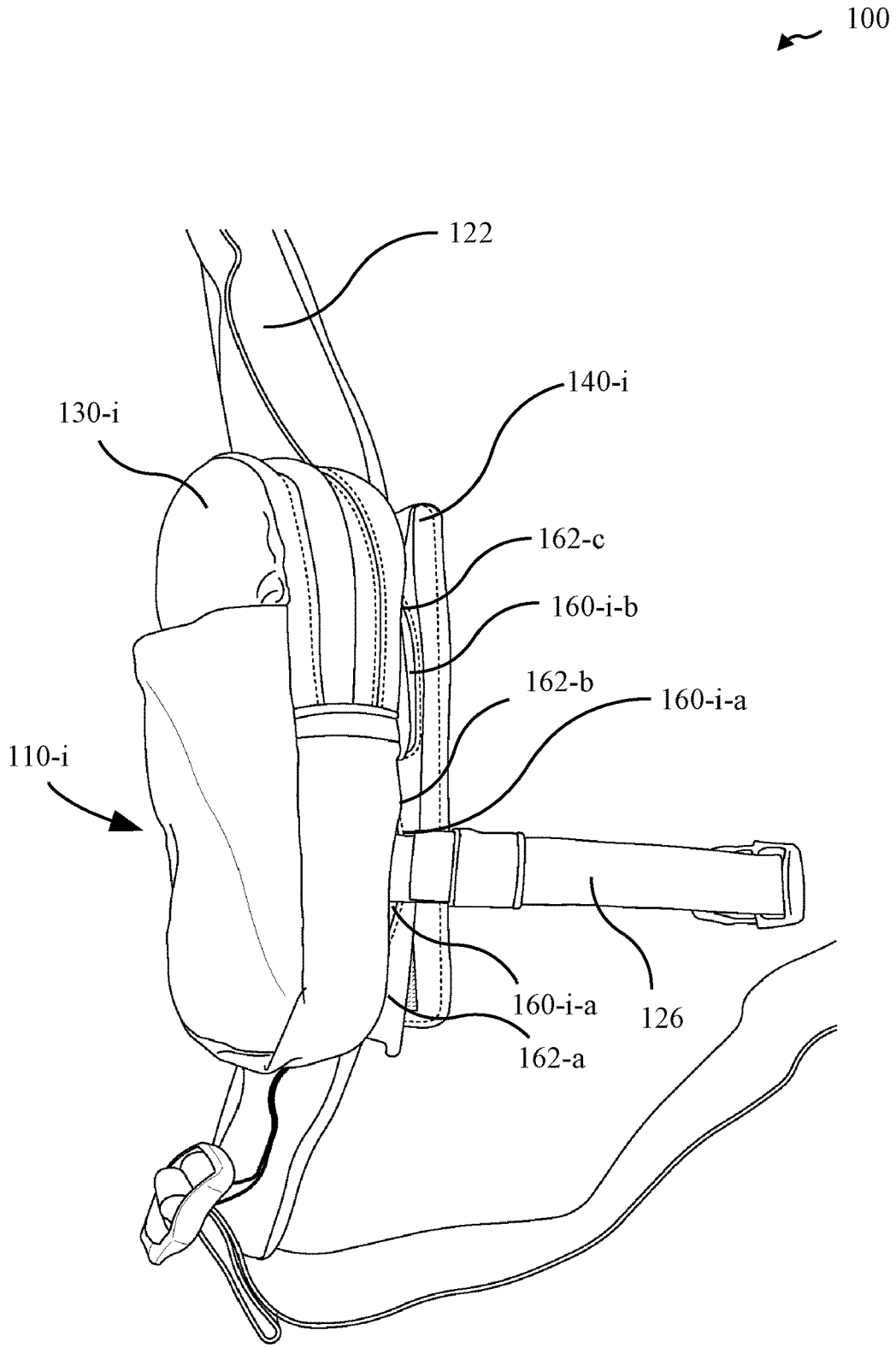
FIG. 6 shows a system and a device in accordance with various embodiments.

FIG. 6 shows another perspective on device 110-*i* as part of system 100. In particular, FIG. 6 may show a sternum strap 126 that may exit from or pass through aperture 160-*i*-*a* so that sternum strap 126 may escape from being trapped between attachment appendages 140-*i* and the backpack accessory 130-*i*. The sternum strap 126 may then couple with an opposing backpack strap. This may further facilitate keeping the backpack accessory 130-*i* from moving up and down the backpack shoulder strap 122. Another aperture 160-*i*-*b* may be shown that may allow for a different positioning of the backpack accessory with respect to the backpack shoulder strap 122. The various apertures 160-*i* may be formed through forming openings between one of the attachment appendages 140-*i* and the backpack accessory 130-*i*. For example, aperture 160-*i*-*a* may be formed with respect to a first attachment point 162-*a* and a second attachment point 162-*b* coupling at least one of the one or more attachment appendages 140-*i* with the backpack accessory 130-*i*. The first attachment point 162-*a* and the second attachment point 162-*b* may be formed as segments between the attachment appendage 140-*i* and the backpack accessory 130-*i*. For example, these segments may represent where the attachment appendage 140-*i* and the backpack accessory 130-*i* may be coupled with each other utilizing a variety of tools and techniques including, but not limited to, sewing, gluing, and/or fusing. In some embodiments, the attachment points 162 may provide a continuous connection between the attachment appendage 140-*i* and the backpack accessory 130-*i*; the apertures 160-*i* may be formed from cutting or otherwise forming the aperture 160-*i* to form between the attachment appendage portion 140-*i* and the backpack accessory 130-*i*.

Reviewing the various figures provided above, one can understand the variety of ways that the device 110 may be coupled and utilized with respect to various backpacks 120 and various backpack shoulder straps 122. The backpack accessory 130, which may include a pocket or other accessories as described else, may hold a wide variety of objects, such as cell phones, passport, GPS devices, and other items. In general, to attach the device 110 one may open the attachment appendage(s) 140 to position a backpack shoulder strap with respect to the back side of the backpack accessory 130. In some embodiments, a sternum strap 126 may be fed through one of the apertures 150 (the aperture(s) may also be referred to as sternum strap holes). The attachment appendage(s) 150 may then wrap around the backpack shoulder strap 122. In some embodiments that may utilize at least two attachment appendages 150, the attachment appendages 150 may be coupled with each other utilize hook and loop or other attachment mechanisms. If a sternum strap 126 has been fed through an aperture 150, the sternum strap 126 may be coupled with an opposing shoulder strap to further secure the device in place.

Figure 7A:
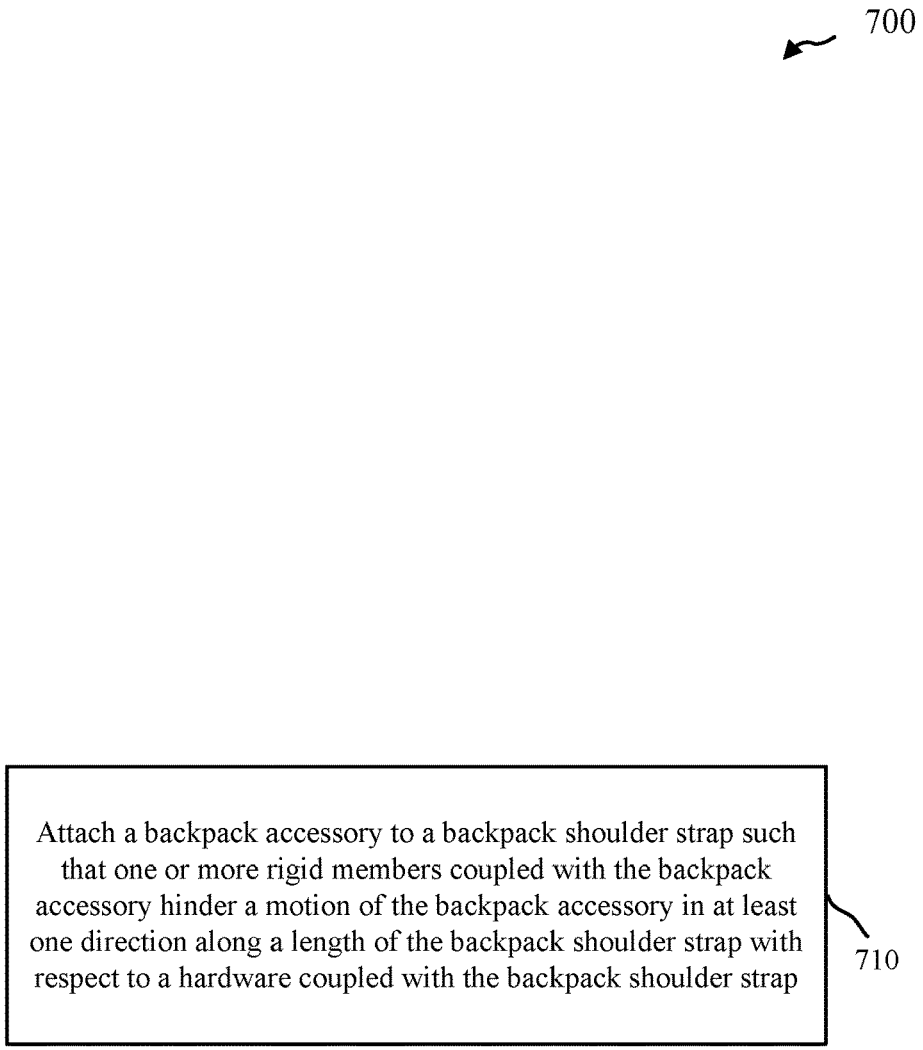
FIG. 7A shows a flow diagram of a method in accordance with various embodiments.

Turning now to FIG. 7A, a flow diagram of a method 700 is shown in accordance with various embodiments. Method 700 may be implemented utilizing a variety of systems and/or devices such as those shown and/or described with respect to FIG. 1, FIG. 2A, FIG. 2B, FIG. 3, FIG. 4A, FIG. 4B, FIG. 5, and/or FIG. 6.

At block 710, a backpack accessory may be attached to a backpack shoulder strap such that one or more rigid members coupled with the backpack accessory hinder a motion of the backpack accessory in at least one direction along a length of the backpack shoulder strap with respect to a hardware coupled with the backpack shoulder strap. In some embodiments of the method 700, attaching the backpack accessory to the backpack shoulder strap such that the one or more rigid members coupled with the backpack accessory hinder the motion of the backpack accessory in at least one direction along the length of the backpack shoulder strap with respect to the hardware coupled with the backpack shoulder strap includes positioning the one or more rigid members coupled with the backpack accessory with respect to the hardware coupled with the backpack shoulder strap.

In some embodiments of the method 700, positioning the one or more rigid members coupled with the backpack accessory with respect to the hardware coupled with the backpack shoulder strap includes trapping the hardware between a first rigid member from the one or more rigid members and a second rigid member from the one or more rigid members. In some embodiments, the hardware coupled with the backpack shoulder strap is coupled with a sternum strap.

In some embodiments of the method 700, attaching the backpack accessory to the backpack shoulder strap includes wrapping one or more attachment appendages coupled with the backpack accessory around the backpack shoulder strap. In some embodiments, wrapping the one or more attachment appendages around the backpack shoulder strap includes wrapping a first attachment appendage around the backpack shoulder strap and a second attachment appendage around the backpack shoulder strap and coupling the first attachment appendage with the second attachment appendage. Some embodiments of the method include passing at least a portion of a sternum strap coupled with the backpack shoulder strap through an aperture formed with respect to a first attachment point and a second attachment point coupling at least one of the one or more attachment appendages with the backpack accessory.

Some embodiments of the method 700 include inserting an object into the backpack accessory where the backpack accessory includes one or more pockets. In some embodiments, the one or more rigid members are formed from high density polyethylene (HDPE). In some embodiments, the one or more rigid members include one or more rigid bars.

Figure 7B:
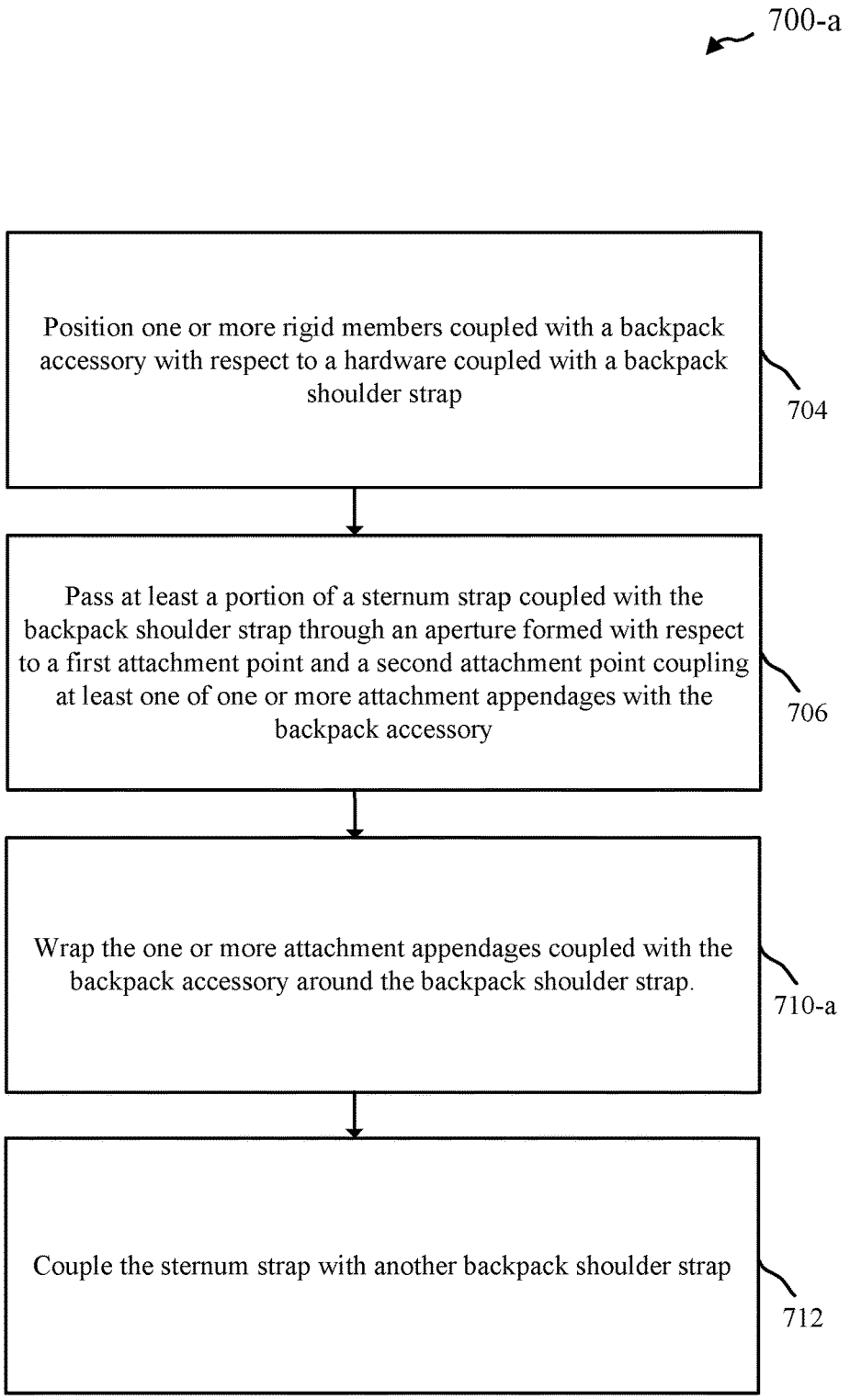
FIG. 7B shows a flow diagram of a method in accordance with various embodiments.

FIG. 7B shows a flow diagram of a method 700-*a* in accordance with various embodiments. Method 700-*a* may be implemented utilizing a variety of systems and/or devices such as those shown and/or described with respect to FIG. 1, FIG. 2A, FIG. 2B, FIG. 3, FIG. 4A, FIG. 4B, FIG. 5, and/or FIG. 6. Method 700-*a* may be an example of method 700 of FIG. 7A.

At block 704, one or more rigid members coupled with a backpack accessory may be positioned with respect to a hardware coupled with a backpack shoulder strap. At block 706, at least a portion of a sternum strap coupled with the backpack shoulder strap may be passed through an aperture formed with respect to a first attachment point and a second attachment point coupling at least one of one or more attachment appendages with the backpack accessory. At block 710-*a*, the one or more attachment appendages coupled with the backpack accessory may be wrapped around the backpack shoulder strap. At block 712, the sternum strap may be coupled with another backpack shoulder strap.

Figure 7C:
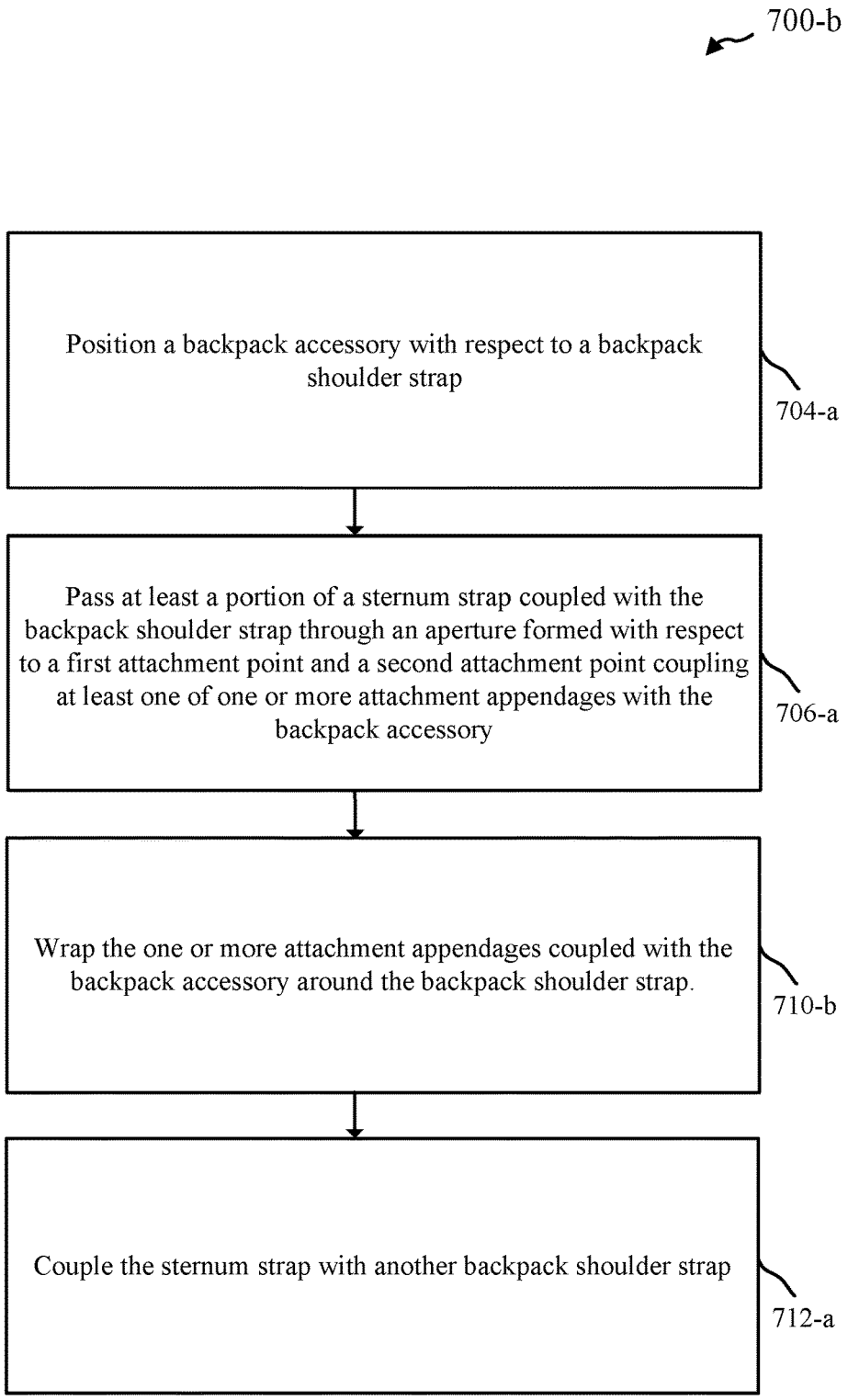
FIG. 7C shows a flow diagram of a method in accordance with various embodiments.

FIG. 7C shows a flow diagram of a method 700-*b* is shown in accordance with various embodiments. Method 700-*b* may be implemented utilizing a variety of systems and/or devices such as those shown and/or described with respect to FIG. 1, FIG. 2A, FIG. 2B, FIG. 3, FIG. 4A, FIG. 4B, FIG. 5, and/or FIG. 6. Method 700-*b* may be an example of aspects of method 700 of FIG. 7 and/or aspects of method 700-*a* of FIG. 7B.

At block 704-*a*, a backpack accessory may be positioned with respect a backpack shoulder strap. At block 706-*a*. at least a portion of a sternum strap coupled with the backpack shoulder strap may be passed through an aperture formed with respect to a first attachment point and a second attachment point coupling at least one of one or more attachment appendages with the backpack accessory. At block 710-*b*, the one or more attachment appendages coupled with the backpack accessory may be wrapped around the backpack shoulder strap. At block 712-*a*, the sternum strap may be coupled with another backpack shoulder strap.

These embodiments may not capture the full extent of combination and permutations of materials and process equipment. However, they may demonstrate the range of applicability of the methods, devices, and/or systems. The different embodiments may utilize more or less stages than those described.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figures.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, a number of stages may be undertaken before, during, or after the above elements are considered. Accordingly, the above description should not be taken as limiting the scope of the different embodiments.

What is claimed is:

1. A device comprising:

a backpack accessory;

one or more attachment appendages coupled with the backpack accessory, wherein the one or more attachment appendages are configured to couple the backpack accessory with a backpack shoulder strap such that a first attachment appendage from the one or more attachment appendages wraps around a posterior portion of the backpack shoulder strap from a first lateral side of the backpack shoulder strap and a second attachment appendage from the one or more attachment appendages wraps around the posterior portion of the backpack shoulder strap from a second lateral side of the backpack shoulder strap such that the first attachment appendage couples with the second attachment appendage to form a first aperture and a second aperture configured such that the backpack shoulder strap passes through the first aperture and the second aperture; and a third aperture formed between a portion of the first attachment appendage and the backpack accessory, wherein the third aperture is configured such that a sternum strap coupled with the backpack shoulder strap passes through the third aperture;

one or more rigid members coupled with the posterior portion of the backpack accessory such that at least one of the one or more rigid members hinder a motion of the backpack accessory in at least a longitudinal direction along a length of the backpack shoulder strap with respect to a hardware coupled with the backpack shoulder strap, wherein the one or more rigid members include a first rigid member and a second rigid member such that the first rigid member and the second rigid member extend laterally across the posterior portion of the backpack accessory such that the hardware coupled with the backpack shoulder strap is confined between the first rigid member and the second rigid member such that the motion of the backpack accessory is hindered along the longitudinal direction along the length of the backpack shoulder strap with respect to the hardware coupled with the backpack shoulder strap.

2. The device of claim 1, wherein the hardware is coupled with the sternum strap coupled with the backpack shoulder strap.

3. The device of claim 1, wherein the one or more rigid members are formed from high density polyethylene (HDPE).

4. The device of claim 1, wherein the backpack accessory includes one or more pockets.

5. The device of claim 1, further comprising a fourth aperture formed between a portion of the second attachment appendage and the backpack accessory, wherein the fourth aperture is configured such that the sternum strap coupled with the backpack shoulder strap passes through the fourth aperture in lieu of the third aperture.

6. The device of claim 1, wherein the first attachment appendage and the second attachment appendage include a hook and loop configuration to couple the backpack accessory with the backpack shoulder strap.

7. The device of claim 1, further comprising one or more pads coupled with at least one of the one or more attachment appendages.

8. The device of claim 1, wherein the one or more rigid members include one or more rigid bars.

9. The device of claim 1, wherein the first attachment appendage forms a first wing that wraps around at least a full width of the posterior portion of the backpack shoulder strap from the first lateral side of the backpack shoulder strap and the second attachment appendage forms a second wing that wraps around the full width of the posterior portion of the backpack shoulder strap from the second lateral side of the backpack shoulder strap to couple with the first wing.

* * * * *